US006230442B1

(12) United States Patent
Kokar

(10) Patent No.: US 6,230,442 B1
(45) Date of Patent: May 15, 2001

(54) BLIND STRUCTURE IN DOUBLE PANED WINDOW WITH A PULLEY AND BAND ACTUATING APPARATUS

(76) Inventor: Dusan Kokar, 2220 Marine Drive, Suite 308, Oakville, Ontario (CA), L6L 5H1

( * ) Notice: Subject to any disclaimer, the term of this patent is extended or adjusted under 35 U.S.C. 154(b) by 0 days.

(21) Appl. No.: 09/575,875

(22) Filed: May 22, 2000

Related U.S. Application Data

(63) Continuation-in-part of application No. 09/168,481, filed on Oct. 8, 1998, now abandoned.

(51) Int. Cl.[7] ..... E06B 7/08
(52) U.S. Cl. ..... 49/64; 49/86.1
(58) Field of Search ..... 49/61, 62, 63, 49/64, 65, 86.1, 74.1; 160/107

(56) References Cited

U.S. PATENT DOCUMENTS

| | | | | |
|---|---|---|---|---|
| 21,408 | * | 9/1858 | Christian | 49/86.1 |
| 3,049,985 | * | 8/1962 | Klingberg | 49/86.1 X |
| 3,201,832 | * | 8/1965 | Hordis et al. | 49/64 |
| 4,702,296 | * | 10/1987 | Anderson | 49/64 |

* cited by examiner

*Primary Examiner*—Jerry Redman

(57) ABSTRACT

A window assembly is provided including a frame and a pane of glass mounted on the frame. Also included is a vane assembly having a plurality of vanes each with a pair of posts coupled to ends thereof and extending therefrom in coaxial relationship for being rotatably coupled with respect to the frame. The posts of the vanes are interconnected for effecting the coincident rotation thereof about parallel axes upon the rotation of at least one of the vanes. Next provided is a manual control mechanism for rotating at least one of the vanes.

1 Claim, 3 Drawing Sheets

42
28
30
39
38
48
5
5
26
32
18
14
12
28
20
58
4
4
56
52
54
50

66
64
18
24
30
40
58
62
14
72
57
68
70
12
20
38
39
22
44
28
42
16
46
34

BLIND STRUCTURE IN DOUBLE PANED WINDOW WITH A PULLEY AND BAND ACTUATING APPARATUS

CROSS REFERENCE TO RELATED APPLICATION

This application is a continuation-in-part of Application Ser. No. 09/168,481, filed Oct. 8, 1998 now abandoned.

BACKGROUND OF THE INVENTION

1. Field of the Invention

The present invention relates to window blind systems and more particularly pertains to a new enclosed window blind system for preventing dust from collecting on a set of blinds.

2. Description of the Prior Art

The use of window blind systems is known in the prior art. More specifically, window blind systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 4,649,980; U.S. Pat. No. 5,379,825; U.S. Pat. No. 4,913,213; U.S. Pat. No. 5,372,173; U.S. Pat. No. 5,249,616; and U.S. Pat. Des. 255,720.

In these respects, the enclosed window blind system according to the present invention substantially departs from the conventional concepts and designs of the prior art, and in so doing provides an apparatus primarily developed for the purpose of preventing dust from collecting on a set of blinds.

SUMMARY OF THE INVENTION

In view of the foregoing disadvantages inherent in the known types of window blind systems now present in the prior art, the present invention provides a new enclosed window blind system construction wherein the same can be utilized for preventing dust from collecting on a set of blinds.

The general purpose of the present invention, which will be described subsequently in greater detail, is to provide a new enclosed window blind system apparatus which has many of the advantages of the window blind systems mentioned heretofore and many novel features that result in a new enclosed window blind system which is not anticipated, rendered obvious, suggested, or even implied by any of the prior art window blind systems, either alone or in any combination thereof.

To attain this, the present invention generally comprises a frame having a front face, a rear face, an inner periphery, and an outer periphery. As shown in FIG. 4, the inner periphery has an inwardly extending lip integrally coupled thereto and extending inwardly therefrom in coplanar relationship with the rear face. Next provided is a pair of panes of glass mounted on an interior surface of the inwardly extending lip. The panes of glass are spaced with respect to each other. This is accomplished by way of a pair of horizontally oriented U-shaped forms mounted between top and bottom edges of the panes and a pair of vertically oriented U-shaped forms mounted between side edges of the panes. The U-shaped forms each define a pair of parallel walls which confine either a vertical slot or a horizontal slot. As shown in FIG. 4, a vertical compartment is defined between one of the vertically oriented U-shaped forms and the inner periphery of the frame. Also included is a vane assembly having a plurality of vanes each with a pair of posts integrally coupled to ends thereof and extending therefrom in coaxial relationship. The posts of each of the vanes are adapted for being rotatably received within an inside bore formed in one of the vertically oriented U-shaped forms such that each post is in a separately defined bore. A plurality of pulleys are provided each having a diameter greater than that of the posts. As shown in the various Figures, each pulley is rotatably mounted within an outside bore formed in one of the vertically oriented U-shaped forms and coupled to one of the posts of the vanes in coaxial relationship therewith. Further, each pulley has a pair of spaced concentric inner grooves formed therein within the slot of the vertically oriented U-shaped form. For reasons that will soon become apparent, a bottommost one of the pulleys has a single outer groove formed in the vertical compartment of the frame. Mounted between the inner grooves of the pulleys and within the vertically oriented forms are a plurality of bands. In operation, the vanes each rotate coincidentally about parallel horizontal axes. For connecting the pulleys of each side, a connector assembly is provided including a horizontally oriented dowel formed in a bottommost one of the horizontally oriented U-shaped forms. A pair of pulleys are mounted on ends of the horizontally oriented dowel, as shown in FIG. 3. These pulleys are adapted for being connected via bands to a bottommost pair of the pulleys within the vertically oriented U-shaped forms. Finally, a manual rotation mechanism includes a knurled disk mounted within a recess formed in the front face of the frame. An axle is mounted on a first side of the disk in concentric relationship therewith for being rotatably received within a lateral conduit formed in the frame. As shown in FIG. 4, mounted on a second side of the disk is a pulley. A band is mounted between a groove of the pulley of the manual rotation mechanism and the outer groove of the bottommost one of the pulleys of the vane assembly. With reference still to FIG. 4, a lateral hole is shown to be formed on an end of the lateral conduit. Such hole serves for receiving a spring and a ball bearing. The ball bearing is positioned between the axle and the spring for abating the rotation thereof. During use, the vanes may be rotated coincidentally via the manual rotation of the disk.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new enclosed window blind system apparatus which has many of the advantages of the window blind systems mentioned heretofore and many novel features that result in a new enclosed window blind system which is not anticipated, rendered obvious, suggested, or even implied by any of the prior art window blind systems, either alone or in any combination thereof.

It is another object of the present invention to provide a new enclosed window blind system which may be easily and efficiently manufactured and marketed.

It is a further object of the present invention to provide a new enclosed window blind system which is of a durable and reliable construction.

An even further object of the present invention is to provide a new enclosed window blind system which is susceptible of a low cost of manufacture with regard to both materials and labor, and which accordingly is then susceptible of low prices of sale to the consuming public, thereby making such enclosed window blind system economically available to the buying public.

Still yet another object of the present invention is to provide a new enclosed window blind system which provides in the apparatuses of the prior art some of the advantages thereof, while simultaneously overcoming some of the disadvantages normally associated therewith.

Still another object of the present invention is to provide a new enclosed window blind system for preventing dust from collecting on a set of blinds.

Even still another object of the present invention is to provide a new enclosed window blind system that includes a frame and a pane of glass mounted on the frame. Also included is a vane assembly having a plurality of vanes each with a pair of posts coupled to ends thereof and extending therefrom in coaxial relationship for being rotatably coupled with respect to the frame. The posts of the vanes are interconnected for effecting the coincident rotation thereof about parallel axes upon the rotation of at least one of the vanes. Next provided is a manual control mechanism for rotating at least one of the vanes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
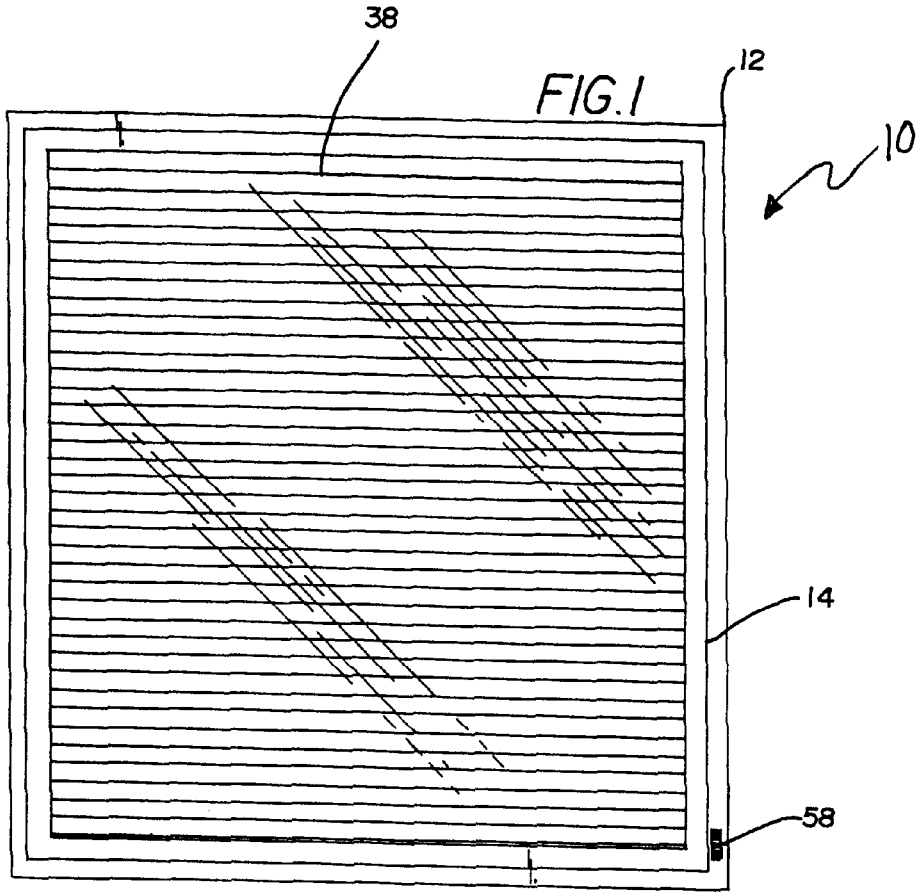
FIG. 1 is a front view of a enclosed window blind system according to the present invention.
Figure 2:
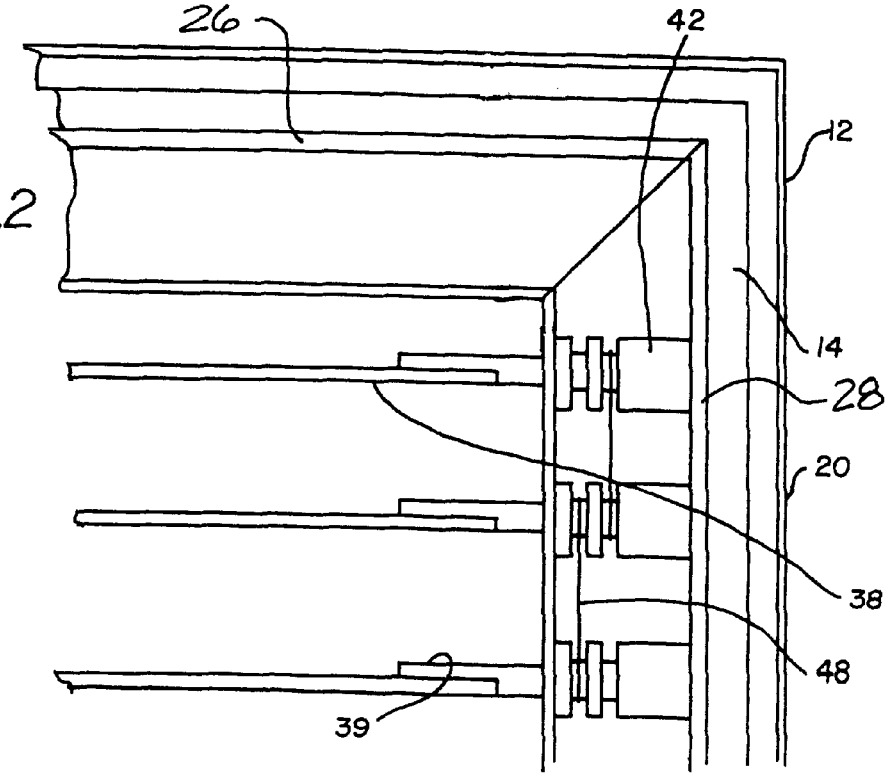
FIG. 2 is a front sectional view of the present invention showing the interconnection of the pulleys.

With reference now to the drawings, and in particular to FIGS. 1 through 5 thereof, a new enclosed window blind system embodying the principles and concepts of the present invention and generally designated by the reference numeral 10 will be described.

Figure 4:
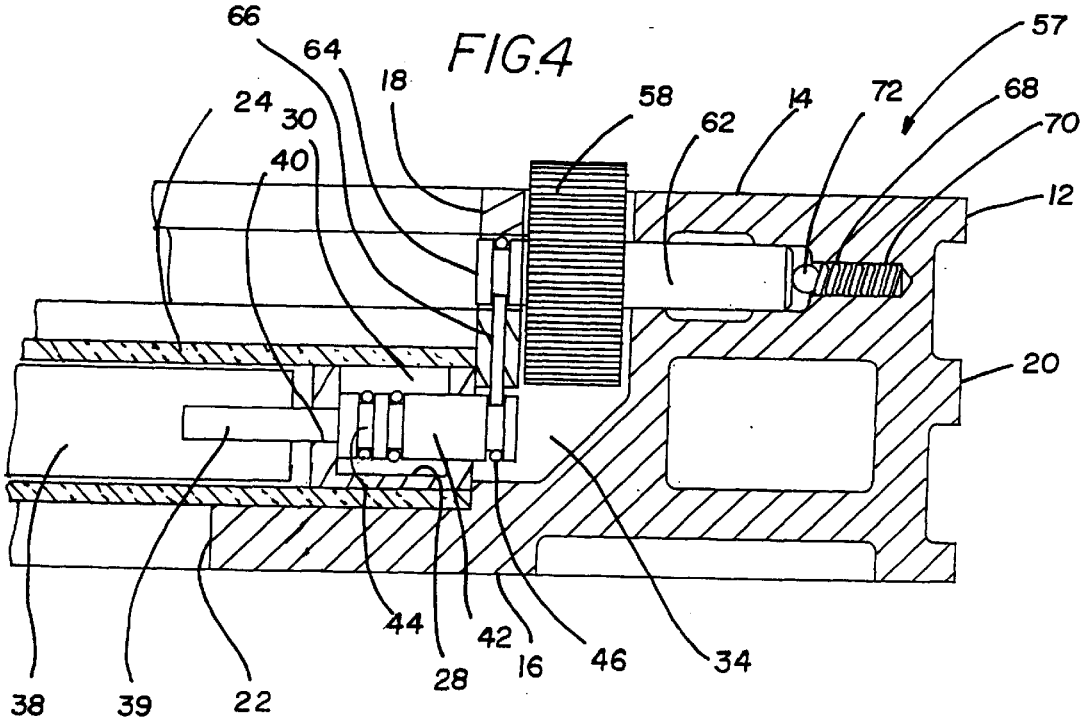
FIG. 4 is a cross-sectional view of the present invention taken along line 4—4 of FIG. 3 and showing the manual rotator mechanism.
Figure 5:
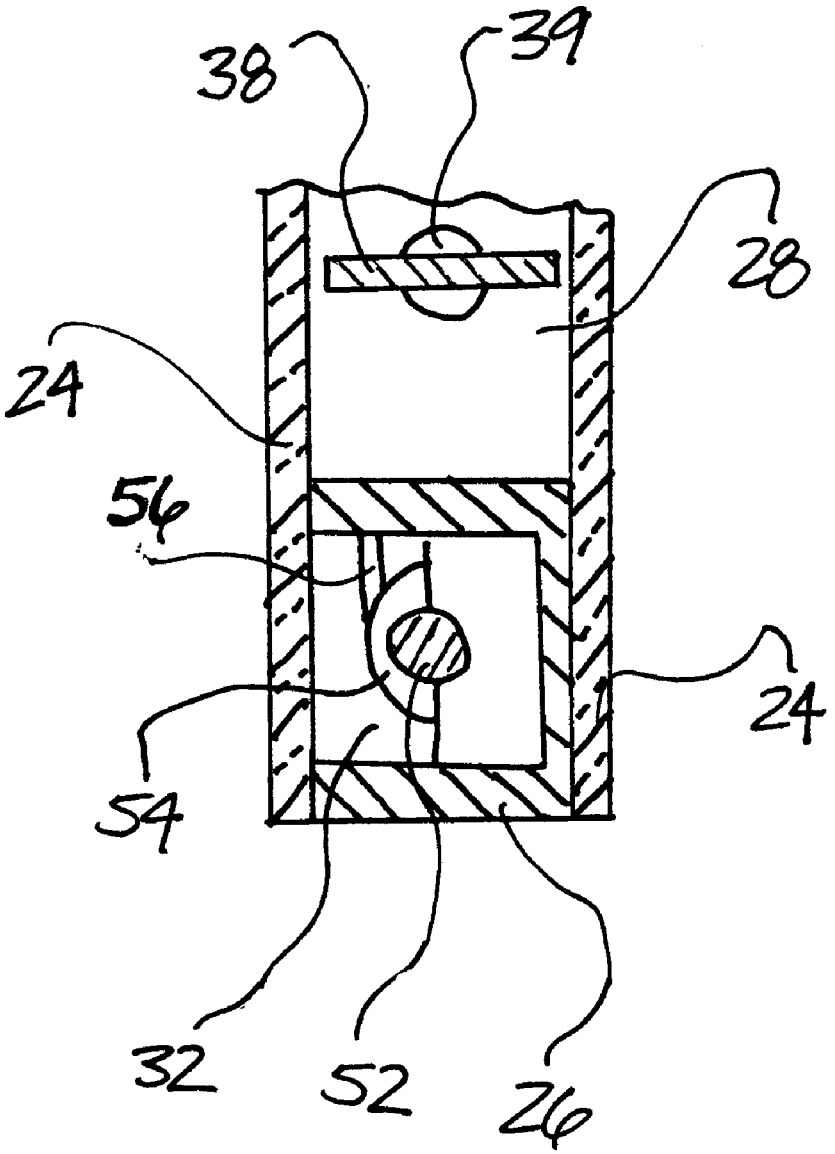
FIG. 5 is a cross-sectional view of the present invention taken along line 5—5 of FIG. 3 and showing a lower portion of the present invention.

The present invention, designated as numeral 10, includes a frame 12 having a front face 14, a rear face 16, an inner periphery 18, and an outer periphery 20. As shown in FIG. 4, the inner periphery has an inwardly extending lip 22 integrally coupled thereto and extending inwardly therefrom in coplanar relationship with the rear face of the frame.

Next provided is a pair of panes of glass 24 mounted on an interior surface of the inwardly extending lip. The panes of glass are spaced with respect to each other. This may be accomplished by way of a pair of horizontally oriented U-shaped forms 26, or channels, mounted between top and bottom edges of the panes and a pair of vertically oriented U-shaped forms 28, or channels, mounted between side edges of the panes. The horizontally-oriented and vertically-oriented U-shaped channels may have mitered ends to form the corners of a substantially rectangular frame. The U-shaped forms each define a pair of parallel walls which form either a vertical slot 30 or a horizontal slot 32. As shown in FIG. 4, a vertical compartment 34 is defined between the outer periphery of the frame and the inner periphery of the frame, and being further defined by one of the vertically oriented U-shaped forms.

Also included is a vane assembly having a plurality of vanes 38 each with a pair of posts 39 integrally coupled to ends thereof and extending therefrom in coaxial relationship. The posts of each of the vanes are adapted for being rotatably received within an inside bore 40 formed in one of the vertically oriented U-shaped forms such that each post is in a separately defined bore. A plurality of pulleys 42 are coupled to the posts of the vanes and are each equipped with a diameter greater than that of the posts. As shown in the various Figures, each pulley is rotatably mounted within an outside bore formed in one of the vertically oriented U-shaped forms. Further, each pulley has a pair of spaced concentric inner grooves 44 formed therein. For reasons that will soon become apparent, a bottommost one of the pulleys has a single outer groove 46 formed in the vertical compartment 34 of the frame. Mounted between the inner grooves of the pulleys and within the vertically oriented forms are a plurality of bands 48. In operation, the vanes each rotate coincidentally about parallel horizontal axes.

Figure 3:
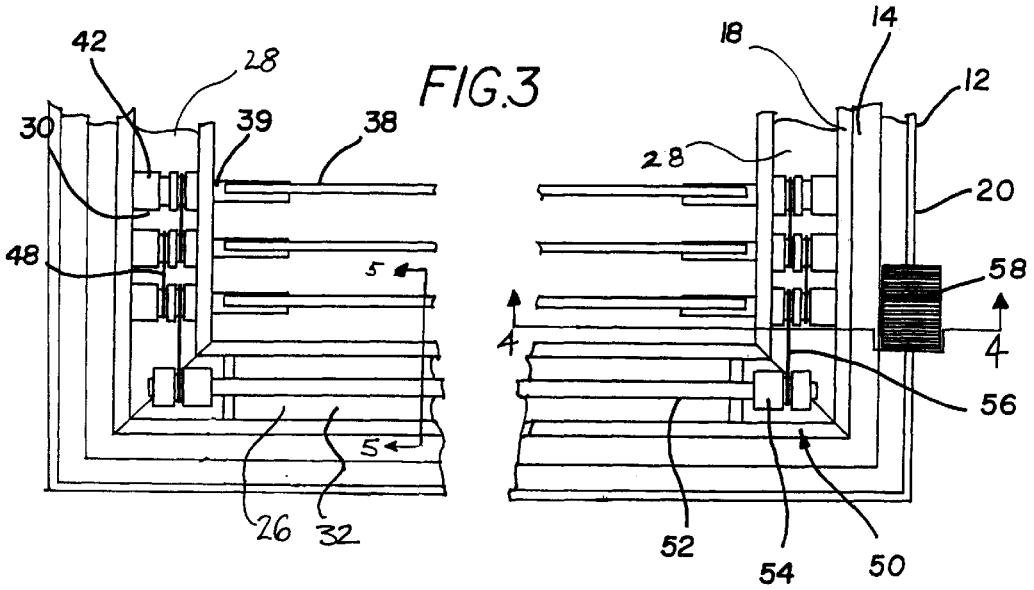
FIG. 3 is a front sectional view of the present invention showing the connector assembly.

For connecting the pulleys of each side, a connector assembly 50 is provided including a horizontally oriented dowel 52 formed in a bottommost one of the horizontally oriented U-shaped forms. A pair of pulleys 54 are mounted on ends of the horizontally oriented dowel, as shown in FIG. 3. These pulleys are adapted for being connected via vertically oriented bands 56 to a bottommost pair of the pulleys within the vertically oriented U-shaped forms. In order for this to be accomplished, it should be noted that the ends of the vertically oriented U-shaped forms and the horizontally oriented forms are interconnected.

Finally, a manual rotation mechanism 57 includes a knurled disk 58 mounted within a recess formed in the front face of the frame. An axle 62 is mounted on a first side of the disk in concentric relationship therewith for being rotatably received within a lateral conduit formed in the frame. As shown in FIG. 4, mounted on a second side of the disk is a pulley 64. A horizontally oriented band 66 is mounted between a groove of the pulley of the manual rotation mechanism and the outer groove of the bottommost one of the pulleys of the vane assembly. With reference still to FIG. 4, a lateral hole 68 is shown to be formed on an end of the lateral conduit. Such hole serves for receiving a spring 70 and a ball bearing 72. The ball bearing is positioned between the axle and the spring for abating the rotation thereof. During use, the vanes may be rotated coincidentally via the manual rotation of the disk. Optionally, the vanes may be mounted so as to rotate about parallel vertical axes of the window.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A window assembly comprising, in combination:

a frame having a front face, a rear face, an inner periphery, and an outer periphery, the inner periphery having an inwardly extending lip integrally coupled thereto and extending inwardly toward a center of said frame in coplanar relationship with the rear face;

a pair of panes of glass mounted on an interior surface of the inwardly extending lip and spaced with respect to each other via a first horizontally oriented U-shaped form mounted adjacent to a top edge of the panes of glass, a second horizontally oriented U-shaped form mounted adjacent to a bottom edge of the panes of glass, and a pair of vertically oriented U-shaped forms mounted between side edges thereof with the U-shaped forms each defining a pair of parallel walls which confine at least one of a vertical slot and a horizontal slot, wherein a pair of vertical compartments are defined between the vertically oriented U-shaped forms and the inner periphery of the frame;

a vane assembly including a plurality of vanes, said vanes each having a pair of opposite ends, each of said ends of said vanes having a post integrally coupled thereto, each of said posts extending away from said vanes in coaxial relationship, each of said posts being rotatably received within a respective inside bore formed in one of the vertically oriented U-shaped forms such that one of said posts is received in one of said bores, a plurality of pulleys each having a diameter greater than a diameter of one of said posts and further each rotatably mounted within an outside bore formed in one of said vertically oriented U-shaped forms and coupled to one of the posts of the vanes in coaxial relationship therewith wherein each pulley has a pair of spaced concentric inner grooves formed therein, and a bottommost one of the pulleys having a single outer groove in a portion of said pulley extending into said vertical compartment of the frame, and a plurality of bands mounted on the inner grooves of the pulleys within the slot of the vertically oriented U-shaped forms, wherein the vanes each rotate coincidentally about parallel horizontal axes;

a connector assembly including a horizontally oriented dowel formed in a bottommost one of the horizontally oriented U-shaped forms with a pair of pulleys one of each of said pair of pulleys being mounted on opposite ends of said dowel for being connected via bands to a bottommost pair of the pulleys; and a manual rotation mechanism including a knurled disk mounted within a recess formed in the front face of the frame, an axle mounted on a first side of the disk in concentric relationship therewith for being rotatably received within a lateral conduit formed in the frame, a pulley mounted on a second side of the disk in concentric relationship therewith, a band mounted between a groove of the pulley of the manual rotation mechanism and the outer groove of the bottommost one of the pulleys of the vane assembly, and a lateral hole formed on an end of the lateral conduit for receiving a spring and a ball bearing positioned between the axle and the spring for abating the rotation thereof, wherein the vanes are rotated coincidentally via the manual rotation of the disk.

* * * * *